United States Patent [19]

Fulkerson

[11] Patent Number: 4,558,749

[45] Date of Patent: Dec. 17, 1985

[54] ANTI-JAMMING CORE BARRELS

[75] Inventor: Larry R. Fulkerson, Sandy, Utah

[73] Assignee: Norton Christensen, Inc., Salt Lake City, Utah

[21] Appl. No.: 542,386

[22] Filed: Oct. 17, 1983

[51] Int. Cl.[4] ..... E21B 25/00

[52] U.S. Cl. ..... 175/58; 175/246; 175/248; 175/249; 175/298

[58] Field of Search ..... 175/246, 248, 249, 298, 175/299, 58, 51, 57; 173/94–97

[56] References Cited

U.S. PATENT DOCUMENTS

| | | | |
|---|---|---|---|
| 1,804,682 | 5/1931 | Fosnaugh et al. | 175/298 |
| 2,005,989 | 6/1935 | Burt | 175/298 |
| 2,204,844 | 6/1940 | Chappell | 175/249 |
| 4,279,315 | 7/1981 | Tibussek | 175/298 |

*Primary Examiner*—Stephen J. Novosad
*Assistant Examiner*—Bruce M. Kisliuk
*Attorney, Agent, or Firm*—Beehler, Pavitt, Siegemund, Jagger & Martella

[57] ABSTRACT

An improved anti-jamming mechanism for use in a coring tool is devised by providing a rotary jar within the inner barrel of the coring tool. The inner barrel is connected to a bearing assembly into which a bearing shaft is axially and concentrically disposed. The bearing assembly is rotatably journaled to the bearing shaft. The bearing shaft is rotatably and longitudinally fixed with respect to the outer barrel of the coring tool. The bearing shaft and bearing assembly are longitudinally displaceable with respect to each other by Bellville washers. The bearing assembly also includes a rotary anvil which is ultimately brought into contact with a rotary hammer which in turn is fixed with respect to the outer barrel. An impulsive torsional and longitudinal force is imparted by the rotary hammer to the rotary anvil through the resilient coupling between the bearing shaft and bearing assembly disposed within the inner barrel.

19 Claims, 3 Drawing Figures

38
34
40
10
18
36
32
26
13
28
30
20
20
22
42
34
24
60
44
50
48
56
54
58
46
62
13
12
64
66
70
24
68
70

70
24
68
12
82
83
74
78
76
85
84
80
86
88
94
90
92
104
110
108
112
114
106
116
94
118
120
96
98
102
100
16

12
122
16
14
124
126

ANTI-JAMMING CORE BARRELS

BACKGROUND OF THE INVENTION

1. Field of the Invention

The invention relates to the field of earth boring tools, and more particularly to rotary jars used in connection with coring tools to free jammed inner core barrels.

2. Description of the Prior Art

Rotary jars are well known to the art and typically include a hammer and anvil in a downhole tool used for transmitting an impulsive force to a fishing tool such as shown by Foster "Oil Well Jar", U.S. Pat. No. 2,153,883, or to a core barrel such as shown by Burt "Core Barrel", U.S. Pat. No. 2,005,989. Typically, such rotary jars use a hammer of cylindrical shape which is rotated about the longitudinal axis of the downhole tool. The hammer has a plurality of ramped surfaces on its butt end which mate a similarly shaped anvil. As the hammer rotates the ramped surfaces of the hammer and anvil ride up against each other to a point of maximum separation and then suddenly jam back together into a mating configuration when the ramped teeth of the hammer and anvil are once again aligned. Examples of such rotary hammers are shown in McLean et al. "Rotary Jar", U.S. Pat. No. 1,535,935, Erwin "Rotary Jar", U.S. Pat. No. 2,153,882, Foster "Oil Well Jar", U.S. Pat. No. 2,153,883 and Fleming "Jar for Fishing and Drilling Tools", U.S. Pat. No. 1,653,093.

However, typically such rotary jars are connected to the fishing tool or coring barrel at a point well above the tool or outside the barrel, such as shown in Burt, supra, as best shown in FIG. 2.

Moreover, prior art jars either continually operate or are selectively activated by some type of mechanism from the well platform. As a result the jar is either operating when not required or not operating for some period when required. In the latter case, only later, after the jam becomes obvious, is the jar activated. Often the jam is then much more severe and is sometimes impossible to unjam. In the former case, continual jarring is not only unnecessary, but may disturb the unjammed core, degrade drilling performance or prematurely wear or cause equipment to fail. Furthermore, prior art jars generally respond with a single magnitude of jarring force regardless of the severity of the jam.

Therefore, what is needed is a rotary jar in combination with a coring tool: wherein an impulsive force is applied to the inner barrel of the coring tool automatically and as soon as a jam occurs but not before; wherein the jar automatically ceases operation when no longer required; wherein a multilevel unjamming force is produced by the jar; and wherein the rotary jar mechanism is contained entirely within the inner barrel to facilitate use of the coring tool during normal, unjammed coring operation.

BRIEF SUMMARY OF THE INVENTION

The invention is an improvement in a rotary jar in a coring tool. The coring tool includes an outer tube or barrel coupled to a coring bit. An inner tube is concentrically disposed within the outer tube and is provided for receiving a core cut by the coring bit. The improvement comprises a rotary hammer concentrically disposed in the outer tube and rotatable therewith. An avnil is connected to the inner tube. The anvil receives and transmits impulsive shocks from the rotary hammer. The impulsive shocks are transmitted from the hammer through the anvil to the inner tube to jar the inner tube free whenever the inner tube becomes jammed about the core.

A resilient mechanism is incorporated within the coring tool as part of the improvement of the invention which automatically and selectively brings the rotary hammer and anvil into an operative relationship for generation of the impulsive shocks.

In the illustrated embodiment, this resilient mechanism comprises a drive assembly concentrically and axially disposed through the outer tube. The rotary hammer is connected to the drive assembly and concentrically disposed thereabout. The axial bearing assembly longitudinally extends through a portion of the coring tool and extends from the rotary hammer into a portion of the inner tube. A bearing journals the drive assembly with respect to the inner tube to permit the inner tube to remain azimuthally stationary with the cut core while the drive assembly rotates with the outer tube in the coring bit. The bearing is disposed between the drive assembly and the inner tube and is thus concentrically disposed about the longitudinal axis about the coring tool and within the inner tube. Washers resiliently and longitudinally position the inner tube with respect to the drive assembly and the rotary hammer. The washers, which are expandable Bellville washers, are coupled to the bearing so that the drive assembly and hammer are longitudinally displaceable with respect to the anvil and the inner tube and yet are freely rotatable with respect thereto to permit operation of the rotary hammer. By reason of this combination of elements, a rotary jar is provided which is entirely disposed within the inner tube of the coring tool and which transmits the impulsive shocks directly to the inner tube of the coring tool.

The mechanism further comprises a compression spring for resiliently and longitudinally positioning the rotary hammer within the outer tube. The spring is coupled between the rotary hammer and the outer tube and forcefully urges the rotary hammer against the anvil. The rotary hammer rotates with the outer tube and the anvil is generally rotatably stationary with respect thereto. The rotary hammer and anvil have a plurality of ramped surfaces arranged in a mating configuration so that rotation of the hammer with respect to the anvil during a core jam, configures the hammer and anvil from a first configuration of intimate mating to a second configuration of maximum misalignment and longitudinal separation. Continued rotation of the hammer with respect to the anvil brings the hammer and anvil back into the first configuration of maximum intimate mating. The hammer is brought back into the maximum mating configuration with an impulsive shock provided by the compression spring. However, although the compression spring provides the main jarring force, an expandable Bellville washers are first compressed prior to any compression of the spring and thereby provides a smaller first resilient force for urging the hammer and anvil back to the normal drilling position. In fact, when the inner tube is not yet jammed hard or has just been substantially but not completely freed, the compression spring might not be compressed at all and the entire resilient, longitudinal force on the inner tube arises solely from the Bellville washers.

The invention, its elements and modes of operation together with its various embodiments can best be understood by considering the above Figures in light of the following detailed description.

DETAILED DESCRIPTION OF THE PREFERRED EMBODIMENTS

The invention is an improvement in a coring bit incorporating a jar mechanism which directly applies an impulsive unjamming longitudinal and torsional force to the inner barrel of the coring bit. The jar mechanism is substantially disposed entirely within the inner barrel thus allowing use of the coring tool during normal coring operations as if no rotary jar mechanism were incorporated within the coring tool and still allowing for automatic initiation of an anti-jamming operation whenever the inner core barrel might become stuck. The invention and its mode of operation can be better understood by now turning to the Figures.

Figure 1:
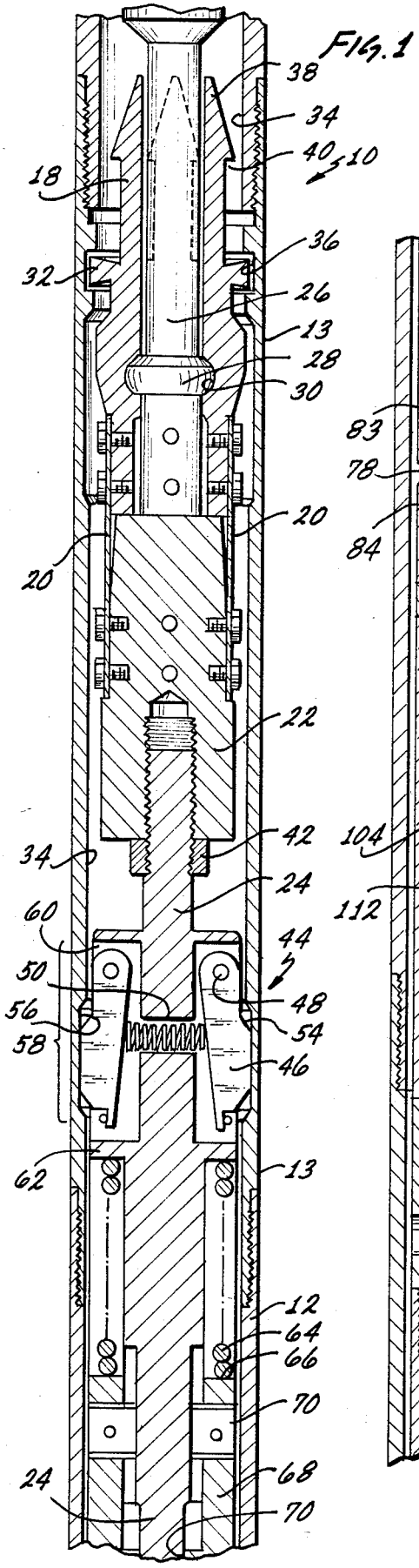
FIG. 1 is a cross-sectional view of a coring tool in which the invention is incorporated showing an upper portion of the coring tool extending from fingers to the drive latch.
Figure 2:
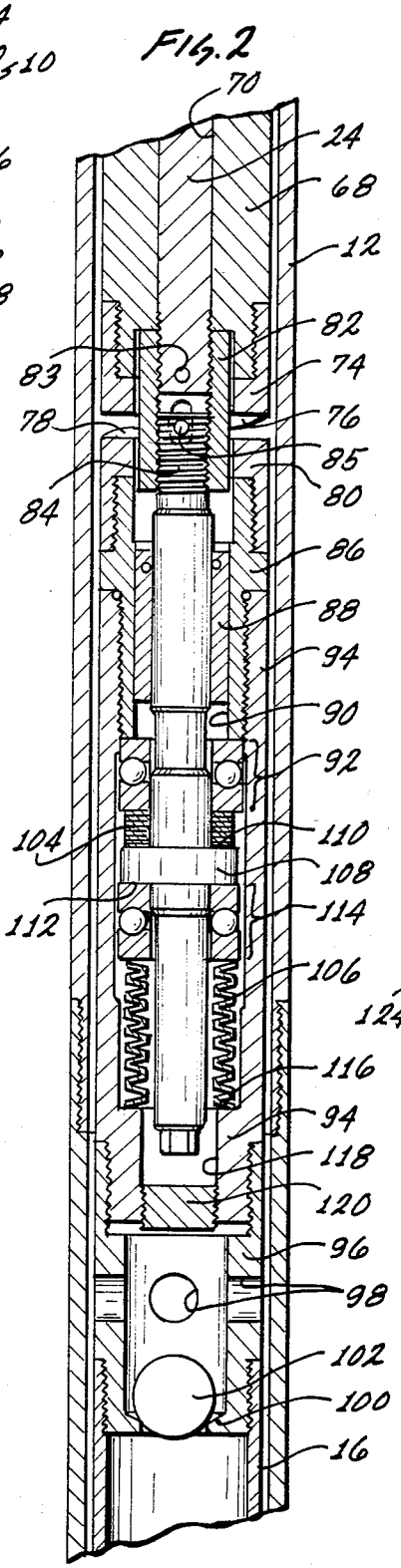
FIG. 2 is a cross-sectional view of the coring tool shown in FIG. 1 for a lower portion of the tool extending from the hammer and anvil to the bearing assembly.
Figure 3:
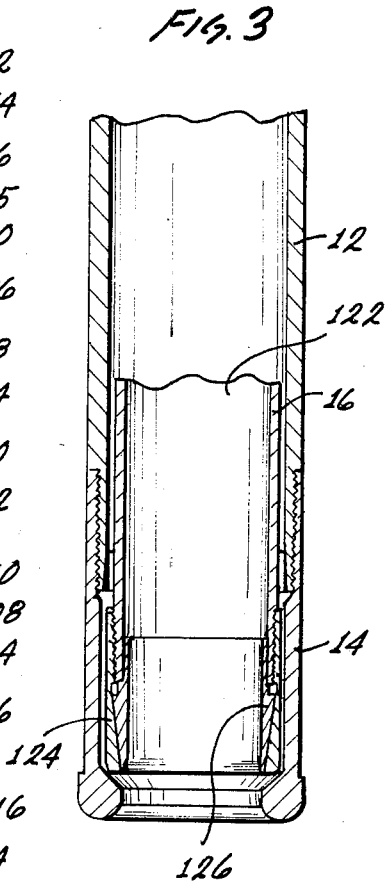
FIG. 3 is a cross-sectional view of the tool shown in FIGS. 1 and 2 showing that portion of the tool extending below the bearing assembly, showing the inner and outer barrels and coring bit.

Turn now to FIG. 1 wherein an upper portion of the tool is illustrated in cross-sectional view. The coring tool, generally referenced by numeral 10, includes an outer coring barrel 12 providing the outer cylindrical casing of tool 10, running its entire length as shown in FIGS. 1–3, and threadably connected to a conventional coring bit 14 as illustrated in the bottom portion of FIG. 3. A plurality of separable fingers 18 are illustrated in the upper portion of FIG. 1 and provide the means whereby inner barrel 16, best illustrated in FIGS. 2 and 3 together with coupled components of coring tool 10 related to inner barrel 16, may be selectively removed and inserted from outer barrel 12. In other words, in the preferred embodiment, tool 10 includes an outer coring barrel 12 together with an internal mechanism as will be described below provided at the end of a drill string. As the coring operation continues, a core (not shown) will be formed and received within the cylindrical space provided by inner barrel 16, best shown in FIG. 3. As a core is cut, it is removed from outer barrel 12 and retrieved at the well surface. The cut core is removed from inner barrel 16, and inner barrel 16 together with its associated mechanism is lowered back into the bore hole within outer barrel 12. The coring operation may then resume and additional cores taken. In the illustrated embodiment outer barrel 12 remains in the bore hole at all times during normal drilling operations.

The plurality of fingers 18 provide the means whereby the inner mechanisms and inner barrel 16 is inserted and removed from outer barrel 12. It is, of course, within the scope of the invention that other types of coring tools could be used, such as tool which would not include removable and insertable interior mechanisms as described below but would require the entire drill string to be tripped in order to take the core.

Return to FIG. 1 wherein each finger 18 is bolted to a corresponding leaf spring 20. The opposing end of each leaf spring 20 is, in turn, bolted to a first mandrel 22. In the preferred embodiment first mandrel 22 is a generally cylindrical body which connects the plurality of fingers 18 to shaft 24.

Second mandrel 26 is axially disposed within outer tube 12 and within a plurality of fingers 18. Second mandrel 26 includes a bulbous termination 28 which is disposed within fingers 18 to engage a corresponding indentation 30 defined in and near the base of each finger 18. Each finger 18 also includes a radially extending dog 32 which rides in sliding contact with interior surface 34 of outer barrel 12. In other words, fingers 18 are resiliently biased by leaf springs 20 such that dogs 32 are maintained in contact with interior surface 34. However, when second mandrel 26 is disposed within fingers 18 and placed within outer barrel 12, fingers 18 are compressed about second mandrel 26 with bulbous portion 28 of mandrel 26 being securely engaged by corresponding indentations 30 of fingers 18. The inside diameter of surface 34 is such that secure engagement between mandrel 26 and fingers 18 is normally retained everywhere within the drill string until fingers 18 reach the position as shown in FIG. 1. When the fingers 18 reach the position of FIG. 1, dog 32 of each finger 18 is resiliently urged by leaf springs 20 into an enlarged radial groove 36 thereby allowing second mandrel 26 to be withdrawn from fingers 18. Typically, mandrel 26 is coupled at its upper end (not shown) to a wire and thus the entire mechanism as described below is lowered within outer barrel 12 by wire through the connection just described between fingers 18 and mandrel 26.

When it becomes desirable to remove the mechanism and inner barrel 16, a tool is lowered which will circumferentially enclose and compress fingers 18. The upper ends 38 of fingers 18 are shaped in the form of arrowheads to snap within a conventional lipped cylindrical member (not shown) disposed over ends 38 with shoulders 40 of each end 38 then bearing against the internal surface of a lip inside the cylindrical member. Fingers 18 are similarly compressed by a sufficient amount so that dog 32 are withdrawn from indentations 36. This then allows the entire mechanism to be lifted by means of fingers 18 from outer barrel 12.

Consider now the lower portion of first mandrel 22. First mandrel 22 is threadably coupled to shaft 24 which is secured thereto by means of a nut 42. Shaft 24 is, in turn, rotatably coupled to a latch mechanisms, generally denoted by reference numeral 44. Latch mechanism 44 includes a plurality of resiliently biased latching arms 46 which pivot about pivot pins 48 connected to shaft 24. Latch arms 46 are resiliently urged apart by means of a compression coil spring 50. The lower end of each latch arm 46 bears against a roll pin 52 which limits the maximum extension of spring 50 and outward movement of arms 46. Each arm 46 includes a latching projection 54 which is shaped as a longitudinal spine and which mates into a corresponding longitudinal groove 56 defined on the inside surface 34 of outer barrel 12.

Thus, as the entire interior mechanism is lowered, spines 54 bear against and slide against interior surface 34 of outer barrel 12 until they reach mating grooves 56. At the same time as latch arms 46 are centrally positioned within longitudinal grooves 56, fingers 18 will extend and dogs 32 will engage indentation 36. Further longitudinal movement of the mechanism is then stopped and rotational movement of the entire mechanism is prohibited by the engagement of spines 54 of latching arms 46 into longitudinal grooves 56.

Shaft 24 expands to a spool-shaped at portion 58 of shaft 24 to provide radially extending members 60 into which pivot pins and roll pins 52 are disposed. Lower shoulder 62 of spool portion 58 of shaft 24 also provides a bearing surface for compression spring 64. Compression spring 64 is concentrically disposed about the extension of shaft 24 beyond spool portion 58 and has one end bearing against bottom shoulder 62 and has the opposing end bearing against upper end 66 of slide 68. Slide 68 is a cylindrical member concentrically disposed within outer barrel 12. Slide 68 includes an axial bore 70 within which shaft 24 is disposed. Therefore, slide 68 and shaft 24 are disposed in a telescopic sliding relationship permitting relative longitudinal displacement of slide 68 with respect to shaft 24. The upper portion of slide 68 is coupled to shaft 24 by means of keys 70. Keys 70 slidingly engage or are splined to longitudinal splines 72 defined in the adjacent portions of shaft 24. Thus, slide 68 is rotationally fixed with respect to shaft 24 but may be longitudinally displaced with respect to shaft 24 against the restoring resilient force provided by compression spring 64. Slide 68 thus is able to move longitudinally upward and downward within outer barrel 12 against spring 64 while rotating with shaft 24 which in turn is rotationally fixed by means of latch arms 46 to outer barrel 12 when operatively configured.

Turning now to FIG. 2, the bottom portion of slide 68 continued from that portion illustrated in FIG. 1 is continued on the upper part of the FIG. 2. Slide 68 terminates in hammer 74 which is threadably connected thereto. Hammer 74 has a plurality of ramped shaped surfaces 76 defined thereon which mate with a corresponding plurality of ramped surfaces 78 defined on an anvil 80 located below hammer 74 as described below. Shaft 24 in turn is threadably coupled to nut 82 which is concentrically disposed about shaft 24 and inside of hammer 74. Nut 82 in turn is pinned by means of expansion collar pin 83 to shaft 24 in order to be rotatably fixed thereto. Nut 82 longitudinally extends down the axis of outer barrel 12 and is similarly threadably connected to bearing shaft 84. Bearing shaft 84 is rotationally fixed with respect to nut 82 by means of roll pin 85. Roll pin 85 is disposed through a longitudinal slot defined through bearing shaft 84 to allow for limited longitudinal displacement of shaft 84 for adjustment of bearing shaft 84 relative to members adjacent to it as described below.

Anvil 80 is concentrically disposed about shaft 84 and in turn is threadably connected to bearing assembly 86. Anvil 84 thus radially aligned with hammer 74. A bronze bearing 88 is concentrically disposed within axial bore 90 of bearing assembly 86 about shaft 84 to provide a concentrically defined radial position for bearing assembly 86 about bearing shaft 84. During normal operation, bearing assembly 86 will be longitudinally fixed with respect to bearing shaft 84.

Bearing assembly 86 rests upon a cylindrical conventional ball bearing assembly generally denoted by reference numeral 92. Bearing assembly 86 is also threadably connected and fixed to bearing housing 94. Bearing housing 94 is concentrically disposed at least in part about bearing assembly 86 and about the remaining portions of the mechanism as described below and within outer barrel 12. As illustrated in FIG. 2, bearing housing 94 extends longitudinally downward and is threadably coupled to a conventional fluid bypass adaptor 96. Fluid bypass adaptor 96 includes a plurality of radial ports 98 and a single longitudinal port 100 which is selectively closed by check ball 102. Thus, when the entire internal mechanism is lowered within outer barrel 12, which is filled with drilling mud, check ball 102 moves upwardly thereby allowing fluid trapped within inner barrel 16 to flow into adaptor 96 and outwardly through radial ports 98 into the space between bearing housing 94 and outer barrel 12. This allows the mechanism to be easily lowered in the fluid filled outer barrel. However, when the mechanism is raised from outer barrel 12, ball 102 is forced downwardly into longitudinal port 100, sealing it. Fluid is then prevented from flowing into the interior cavity defined by inner barrel 16 thereby preventing the core from being washed out during retrieval of the core from the bore hole.

Return now to the mechanism included within bearing assembly 86 and bearing housing 94 as shown in FIG. 2. As stated, bearing assembly 86 is supported by and rests upon cylindrical ball bearing assembly 92 which is also concentrically disposed about bearing shaft 84. Ball bearing assembly 92 in turn is supported by and rests on upper Bellville washers 104. In the configuration shown in FIG. 2, upper Bellville washers 104 are completely compressed, while lower Bellville washers 106 are extended. Below upper Bellville washers 104 bearing shaft 84 extends radially outward to form an integral collar 108 to define a shoulder 110 upon which the opposing or lower end of upper Bellville washers 104 rests. Similarly, lower shoulder 112 of collar 108 of bearing shaft 84 provides a bearing surface for lower ball bearing assembly 114. Lower ball bearing assembly 114 in turn is supported by and rests upon lower Bellville washers 106 which are also concentrically disposed about bearing shaft 84. The opposing or lower end of lower Bellville washers 106 bears against shoulder 116 defined within bearing housing 94. Bearing shaft 84 similarly extends and terminates within an axial bore 118 defined within bearing housing 94. Axial bore 118 is sealed by plug 120. However, sufficient longitudinal clearance exists between the lowermost end of bearing shaft 84 and plug 120 to permit the entire expected longitudinal displacement of bearing assembly 86 and bearing housing 94 with respect to shaft 84.

Now it may be understood, the various parts and their connections having been described, how the mechanism shown in FIG. 2 operates in part. Bearing housing 94 and bearing assembly 86 are both freely longitudinally and rotatably moveable with respect to bearing shaft 84 and latching shaft 24. Bearing housing 94 and bearing assembly 86 therefore form a telescopic element with respect to bearing shaft 84 and may thus be longitudinally displaced with respect to shaft 84 and may remain stationary while outer barrel 12 continues to rotate with shaft 84. Therefore, as shaft 84 moves downwardly with respect to bearing housing 94, lower Bellville washers 106 will become compressed while upper Bellville washers 104 expand. Thus, shaft 84 is able to reciprocate longitudinally within bearing housing 94 and bearing assembly 86 while remaining in a rotatably journaled relationship thereto by means of Bellville washers 104 and 108 in combination with ball bearing assemblies 92 and 114.

Fluid bypass adaptor 96 is threadably connected to inner barrel 16 as shown in FIG. 2. Turning to FIG. 3, inner barrel 16 thus continues longitudinally within outer barrel 12 to define receiving space 122. Inner barrel 16 is threadably connected to lower shoe 124 which provides the termination for inner barrel 16 and coacts with a conventional core catcher 126 which is concentrically disposed within shoe 124. Core catcher 126 operates in connection with shoe 124 to grip, compress, and break the core cut by coring bit 114 and disposed within receiving space 122.

The overall operation of the coring tool may now be described. The entire mechanism is in place as illustrated in FIGS. 1–3 when the coring operation has begun. A predetermined length of core is cut and will normally be disposed within receiving space 122 within inner barrel 16. A core retrieving tool will be lowered (not shown) which will grasp ends 38 of fingers 18 as previously described, thereby freeing fingers 18 from outer barrel 12. The inner mechanism will then be pulled upwardly by a cable thereby activating core catcher 126 to compress and break the core from the underlying rock formation. The core will thus be retrieved. Thereafter, an empty coring mechanism will be lowered by means of second mandrel 26 as described above and snap locked by means of fingers 18 by engagement of dogs 32 within indentations 36 of outer barrel 12. The tool will then be in a position to take a second core. Normally, inner barrel 16 will remain rotationally fixed with the core as outer barrel 12 rotates. As described above, inner barrel 16 is not rotationally fixed in any manner with respect to outer barrel 12 or to bearing shaft 84 which in turn is rotatably fixed to outer barrel 12 through nut 82, slide 68, shaft 24 and latching arms 46.

However, if at any time the core becomes jammed within inner barrel 16, inner barrel 16 will no longer be longitudinally advanced as additional core material is cut by bit 14. Outer barrel 12 will then be longitudinally displaced downward with respect to inner barrel 16 and to bearing housing 94 and assembly 86 which are coupled to inner barrel 16. Ultimately, anvil 80 will move upward and contact hammer 74. Lower Bellville washers 106 will begin to be compressed while upper Bellville washers extends. Continued movement of inner barrel 16 upwardly will continue to compress lower Bellville washers 106 and extend upper Bellville washers 104, thereby increasing the force by which hammer 74 impacts against anvil 80. However, inasmuch as inner barrel 16 will also generally be rotationally stuck, hammer 74, which is continuing to rotate with slide 68 and outer barrel 12, will cause the series of ramp-like projections on hammer 74 to ride up and over the corresponding plurality of mating ramp-like projections on anvil 80, thereby providing the impulsive hammering force.

Inasmuch as mating surfaces 76 and 78 of hammer 74 and anvil 80 respectively are inclined ramps, a portion of the impulsive force applied to anvil 80 from hammer 74 will be translated into a rotational component and a portion translated into a longitudinal component. Therefore, the impulsive hammering action will tend not only to longitudinally free inner barrel 16 from the core but also to rotate inner barrel 16 with respect to the core to allow free relative movement. Eventually, inner barrel 16 will be freed from the core and will resume an unjammed configuration as depicted in the drawings.

Therefore, what has been described is an improved antijamming mechanism within a coring tool which is entirely disposed within inner barrel 16 and which applies a torsional and longitudinal impulsive anti-jamming force to inner barrel 16 automatically whenever inner barrel 16 becomes jammed about a core. Otherwise, the jar mechanism does not operate. Operation is initiated, however automatically without the well operator's knowledge or intervention.

However, it must be understood that many modifications and alterations may be made by those having ordinary skill in the art without departing from the scope of the invention. For example, Bellville washers 104 and 106 could be replaced by other resilient members, such as compression springs. Furthermore, the number of ramps on hammer 74 may be altered to change the number of impacts per revolution as well as the angle of the ramps to change the amount of torsional impulsive force versus longitudinal impulsive force. In addition, drive spring 64 may be changed to vary the stiffness of the spring to change the magnitude of the impact between hammer 74 and anvil 80. Further, the relative stiffness of spring 64 and Bellville washers 104 and 106 can be varied to alter the nature of the response of the jar.

Therefore, what has been described in the illustrated embodiment is to be taken only by way of example and not limitation as a means of illustrating the invention as defined in the following claims.

I claim:

1. In a rotary jar in a coring tool including an outer tube coupled to a coring bit and concentrically disposed therein an inner tube for receiving a core cut by said coring bit, an improvement comprising:

a rotary hammer concentrically disposed in said outer tube and rotatable therewith;

an anvil for receiving and transmitting impulsive shocks from said rotary hammer, said anvil being connected to said inner tube, said impulsive shocks being transmitted from said hammer through said anvil to said inner tube to jar said inner tube free when said inner tube becomes jammed about said core; and means for automatically and for selectively engaging said hammer and anvil without operator intervention only when said inner tube jams in order to automatically, selectively and intermittently generate said impulsive shocks therebetween.

2. The improvement of claim 1 wherein said means automatically and selectively generates said impulsive shocks in increasing magnitudes.

3. The improvement of claim 2, wherein said means comprises:

an axial drive assembly, said rotary hammer being connected to and concentrically disposed about said axial drive assembly, said axial bearing assembly longitudinally extending through a portion of said coring tool, said bearing assembly extending longitudinally from said rotary hammer and into a portion of said inner tube;

bearing means for journaling said drive assembly with respect to said inner tube to permit said inner tube to remain azimuthally stationary while said drive assembly rotates with said outer tube and coring bit, said bearing means being disposed between said drive assembly and inner tube and thus being concentrically disposed about the longitudinal axis of said coring tool within said inner tube; and washer means for resiliently, longitudinally positioning said inner tube with respect to said drive assembly and rotary hammer, said washer means being coupled to said bearing means so that said drive assembly and hammer are longitudinally displaceable with respect to said anvil and inner tube and freely rotatable with respect thereto to permit operation of said rotary hammer, whereby a rotary jar is provided entirely within said inner tube of said coring tool and transmits said impulsive shocks directly to said inner tube of said coring tool.

4. In a rotary jar in a coring tool including an outer tube coupled to a coring bit and concentrically disposed therein an inner tube for receiving a core cut by said coring bit, an improvement comprising:

a rotary hammer concentrically disposed in said outer tube and rotatable therewith;

an anvil for receiving and transmitting impulsive axial shocks from said rotary hammer, said anvil being connected to said inner tube, said impulsive shocks being transmitted from said hammer through said anvil to said inner tube to jar said inner tube free when said inner tube becomes jammed about said core;

means for automatically and selectively engaging said hammer and anvil to automatically and selectively generate said impulsive shocks therebetween, said means automatically and selectively generating said impulsive shocks in increasing magnitudes, wherein said means comprises:

an axial drive assembly, said rotary hammer being connected to and concentrically disposed about said axial drive assembly, said axial drive assembly longitudinally extending through a portion of said coring tool, said drive assembly extending longitudinally from said rotary hammer and into a portion of said inner tube;

bearing means for journaling said drive assembly with respect to said inner tube to permit said inner tube to remain azimuthally stationary while said drive assembly rotates with said outer tube and coring bit, said bearing means being disposed between said drive assembly and inner tube and thus being concentrically disposed about the longitudinal axis of said coring tool within said inner tube; and washer means for resiliently, longitudinally positioning said inner tube with respect to said drive assembly and rotary hammer, said washer means being coupled to said bearing means so that said drive assembly and hammer are longitudinally displaceable with respect to said anvil and inner tube and freely rotatable with respect thereto to permit operation of said rotary hammer, wherein said means further comprises spring means for resiliently longitudinally positioning said rotary hammer within said outer tube, said spring means coupled between said rotary hammer and said outer tube for forcefully urging said rotary hammer against said anvil, said rotary hammer rotating with said outer tube and said anvil generally being rotatably stationary, said rotary hammer and anvil having a plurality of ramped surfaces arranged in mating configuration so that rotation of said hammer with respect to said anvil configures said hammer and anvil, during a core jam, from a first configuration of intimate mating to a second configuration of maximum misalignment and longitudinal separation, continued rotation of said hammer with respect to said anvil bringing said hammer and anvil back into said first configuration of maximum, intimate mating, said hammer being brought back into said first configuration with said impulsive shock provided by said spring means, whereby a rotary jar is provided entirely within said inner tube of said coring tool and transmits said impulsive shocks directly to said inner tube of said coring tool.

5. The improvement of claim 4 wherein said spring means is a coil compression spring bearing against said axial drive assembly on one end and fixedly coupled to said outer tube at said other end whereby said impulsive shocks transmitted from said hammer to said anvil by compression of said coil spring when said hammer and anvil rotate relative to one another from said first to second configuration and back to said first configuration again.

6. In a rotary jar in a coring tool including an outer tube coupled to a coring bit and concentrically disposed therein an inner tube for receiving a core cut by said coring bit, an improvement comprising:

a rotary hammer concentrically disposed in said outer tube and rotatable therewith said hammer having a plurality of flat, inclined surfaces;

an anvil for receiving and transmitting impulsive axial shocks from said rotary hammer, said anvil being connected to said inner tube, said impulsive shocks being transmitted from said hammer through said anvil to said inner tube to jar said inner tube free when said inner tube becomes jammed about said core; and means for automatically and selectively generating said impulsive shocks, said means being coupled to said anvil and to said rotary hammer and being disposed in part within said inner tube, said means for automatically and selectively generating said impulsive shocks between said hammer and anvil being activated by longitudinal displacement of said inner tube with respect to said outer tube.

7. The improvement of claim 6 wherein said means for automatically and selectively generating said impulsive shocks comprises spring means for resiliently and longitudinally urging said rotary hammer against said anvil, said spring means being coupled at one end to said outer tube and coupled at the opposing end to said rotary hammer, said rotary hammer being in turn longitudinally displaceable with respect to said outer tube but rotatable therewith.

8. The improvement of claim 6 wherein said means for automatically and selectively generating said impulsive shocks between said hammer and anvil comprises washer means for resiliently and longitudinally positioning said inner tube with respect to said hammer, said washer means being coupled to said hammer on one end and to said anvil on the opposing end to permit longitudinal displacement of said anvil within said outer tube and with respect to said hammer, thereby allowing said impulsive shocks between said rotary hammer and anvil.

9. The improvement of claim 6 wherein said means for automatically and selectively generating said impulsive shocks comprises spring means for resiliently and longitudinally urging said rotary hammer against said anvil, said spring means being coupled at one end to said outer tube and coupled at the opposing end to said rotary hammer, said rotary hammer being in turn longitudinally displaceable with respect to said outer tube but rotatable therewith.

10. An improvement in a coring tool including an inner and outer barrel comprising:

a rotary hammer rotatably fixed with respect to said outer barrel;

a bearing shaft connected to said rotary hammer and longitudinally extending within said inner barrel;

a bearing assembly concentrically disposed about said bearing shaft and connected to said inner barrel;

a rotary anvil connected to said bearing assembly, said anvil coacting with said hammer to create a repetitive impulsive force therebetween as said hammer rotates with respect to said anvil;

bearing means for journaling said bearing shaft to said bearing assembly to allow said bearing assembly to rotate freely with respect to said bearing shaft; and first washer means for resiliently biasing said rotary hammer with respect to said bearing shaft, whereby movement of said outer barrel with respect to said inner barrel loads said first washer means thereby imparting in part a force between said rotary hammer and rotary anvil.

11. The improvement of claim 10 further comprising a second washer means for providing a resilient coupling between said bearing shaft and bearing assembly, said second washer means also for providing a force between said rotary hammer and rotary anvil after said inner barrel has been longitudinally displaced relative to said outer barrel by a predetermined displacement.

12. The improvement of claim 10 further comprising a compression spring coupled to said outer barrel at one end and to said rotary hammer at said other end, said rotary hammer being longitudinally displaceable within said outer barrel to thereby compress said spring when said rotary hammer and rotary anvil are in compressive contact when said inner barrel is longitudinally displaced within said outer barrel, said compression spring urging said hammer and anvil into intimate contact as said hammer rotates with said outer barrel.

13. A rotary jar in a coring tool including an outer barrel coupled to a coring bit and concentrically disposed therein an inner barrel for receiving a core cut by said coring bit, said rotary jar comprising:

a rotary hammer having a plurality of ramped surfaces defined thereon, said rotary hammer being disposed within said outer barrel above said inner barrel;

a generally nonrotating anvil having a corresponding plurality of ramp-like surfaces defined thereon for mating with said like plurality of ramp-like surfaces on said rotary hammer, said hammer and anvil varying, during a core jam, from a first configuration of intimate mating to a second configuration of maximal misalignment and longitudinal displacement as said hammer rotates with respect to said anvil, said hammer suddenly realigning with said anvil to reassume said first configuration just after said second configuration of maximal misalignment has past, said anvil being coupled to said inner barrel, said inner barrel rotating, if at all, independently from said outer barrel; and spring means for urging said hammer and anvil into said first configuration of maximal intimate mating, said spring means being automatically and selectively activated by a predetermined magnitude of longitudinal displacement of said inner barrel with respect to said outer barrel, whereby a jar is provided in a coring tool which is automatically activated to create a plurality of jarring forces applied to said inner barrel whenever said inner barrel is longitudinally displaced with respect to said outer barrel beyond said predetermined distance.

14. The rotary jar of claim 13 wherein said spring means comprises a compression spring coupled on one end to said outer barrel and on the other end to said rotary hammer wherein said compression spring is compressed by engagement of said hammer and anvil in said first and second configuration, said compression spring urging said hammer to forcefully return to said first configuration after said second configuration of said hammer and anvil has been achieved, whereby longitudinal displacement of said inner barrel with respect to said outer barrel causes activation of said jarring force in proportion to the magnitude of said displacement.

15. The rotary jar of claim 13 wherein said rotary hammer, anvil and spring means are concentrically disposed within said outer barrel and selectively disposed therein and removable therefrom.

16. The rotary jar of claim 15 further comprising latching means for selectively disposing said rotary hammer, anvil and spring means within said outer barrel, said latching means being coupled to said hammer and selectively removable from said outer barrel.

17. The rotary jar of claim 16 further comprising:

an axial drive and bearing assembly extending from said latching means into said inner barrel and through said anvil, said anvil being concentrically disposed thereabout; and slider means being concentrically disposed about said axial rod and longitudinally displaceable within said outer barrel and with respect to said axial rod, said slider means being rotatably fixed with respect to said axial rod, said axial rod being coupled to said latching means and said latching means being rotatably fixed with respect to said outer barrel.

18. The rotary jar of claim 17 further comprising washer means concentrically disposed about said axial rod for carrying said anvil and permitting longitudinal displacement of said anvil with respect to said axial rod by said predetermined distance so that said anvil is automatically and selectively disengaged from contact with said rotary hammer until said inner barrel is longitudinally displaced with respect to said outer barrel beyond a predetermined distance.

19. A method for automatically and selectively applying a jarring force to an inner barrel concentrically disposed within an outer barrel of a coring tool comprising the steps of:

rotating a hammer having a plurality of ramped surfaces defined thereon with rotation of said outer barrel;

selectively and automatically bringing said rotating hammer into contact with a nonrotating anvil coupled to said inner barrel by longitudinal displacement of said anvil within said outer barrel through a predetermined distance, said anvil having defined thereon a corresponding mating plurality of ramp-like surfaces to thereby coact with said plurality of said ramp-like surfaces on said rotating hammer to repetitively generate a plurality of impulsive hammering forces between said anvil and hammer as said hammer contiues to rotate with respect to said anvil;

generating said plurality of impulsive hammering forces between said anvil and hammer;

continuing to longitudinally displace said hammer and anvil against a resilient force to thereby substantially increase the magnitude of said impulsive hammering forces generated between said hammer and anvil, said hammering impulsive forces continuing until said inner barrel is freed; and selectively and automatically longitudinally displacing said anvil in an opposite direction to reassume the configuration of said hammer and anvil wherein said hammer and anvil are not in contact.

* * * * *